United States Patent [19]

Damus et al.

[11] Patent Number: 4,856,912

[45] Date of Patent: Aug. 15, 1989

[54] COMBINATION BEACH TOWEL AND TOTE BAG

[76] Inventors: Diane Damus, 200 C, Rte. 3; John F. Kleinstuber, 202 C, #3, both of Fenwick Island, Del. 19944

[21] Appl. No.: 189,715

[22] Filed: May 3, 1988

[51] Int. Cl.[4] ..... B65D 30/00

[52] U.S. Cl. ..... 383/4; 383/72; 150/100; 190/2; 33/270

[58] Field of Search ..... 383/4, 72, 75, 71, 79, 383/92; 150/100, 103, 106; 190/2; 33/270

[56] References Cited

U.S. PATENT DOCUMENTS

| | | | |
|---|---|---|---|
| D. 128,122 | 7/1941 | Lewis . | |
| 2,315,126 | 3/1943 | Michalke . | |
| 2,344,010 | 3/1944 | Walsh . | |
| 2,479,203 | 8/1949 | Brown | 383/72 |
| 2,626,648 | 1/1953 | Anderson | 383/4 |
| 2,659,404 | 11/1953 | Kelsey . | |
| 2,691,998 | 10/1954 | Stucker | 383/72 |
| 2,731,997 | 1/1956 | Muth et al. | 383/4 |
| 2,791,775 | 5/1957 | Bartell . | |
| 3,176,315 | 4/1965 | Freund . | |
| 3,477,552 | 11/1969 | Goldman . | |
| 3,976,113 | 8/1976 | Kim . | |
| 4,195,378 | 4/1980 | Parker . | |
| 4,197,891 | 4/1980 | Comollo . | |
| 4,375,111 | 3/1983 | Hall . | |
| 4,489,815 | 12/1984 | Martinez et al. | 383/4 |
| 4,516,668 | 5/1985 | Grayek . | |

FOREIGN PATENT DOCUMENTS

| | | | |
|---|---|---|---|
| 2047548 | 4/1971 | Fed. Rep. of Germany | 383/4 |

*Primary Examiner*—Willis Little

*Attorney, Agent, or Firm*—Dowell & Dowell

[57] ABSTRACT

A beach towel which is selectively convertible to a tote bag or beach bag wherein the towel has upper and lower surface portions having a generally annularly oriented pull cord substantially confined therebetween but extending outwardly on opposite sides of the towel so that as the outwardly extending portions of the pull cord are raised, the central portion of the towel surrounded by the pull cord will form a carrying pouch having an opening which is closed by the pull cord. In one embodiment of the invention, the upper surface of the beach towel may also be provided with indicia which is simulative of the face of a sun dial whereby a person or a separate shoulder strap associated with the beach towel may be utilized as the gnomon of the sun dial to indicate approximate time of day when the beach towel is properly oriented.

15 Claims, 3 Drawing Sheets

15
19
29
36
33
32
28
18
27
21
23
20
12
60
26
21
40
C
5
5
6
6
17
10
30
34
16
35
31

15
19
13
20
22
25'
17
21
26
27
21
18
10
25
25''
24
20
16

COMBINATION BEACH TOWEL AND TOTE BAG

BACKGROUND OF THE INVENTION

1. Field of the Invention

This invention is generally directed to beach towels and the like and more specifically to a beach towel which may be easily and directly converted to a beach bag or a tote bag without requiring the towel to be folded so the tote bag may be utilized to carry various articles including clothing and other personal belongings to and from a beach, pool or other recreational area. The beach towel is also provided with a plurality of corner pockets which may be utilized to selectively store or house such items as keys, change, sunglasses, watches and the like so that such items are not accidentally lost or directly exposed to the sun or other elements. Further, the pockets are designed in such a manner that as the beach towel is converted to a tote bag or beach bag, the pockets will automatically assume a position with the opening to the pockets being vertically spaced above the bottom portion of the pockets so that items carried therein will not become accidentally dislodged. In addition, the pockets associated with the beach towel may either be suspended on the exterior of the tote bag pouch or may be retained inside the pouch of the tote bag or beach bag by folding the corners of the towel inwardly towards the center of the towel prior to its being converted to a tote bag. In this manner, the style or configuration of the tote bag may be selectively altered.

The beach towel of the present invention may also include a shoulder carrying strap which may be selectively stored when not in use in one of the pockets or may be attached to the outwardly extending portions of a pull cord which is sewn or otherwise secured between the upper and lower surfaces of the beach towel with the carrying strap being positioned beneath the beach towel when the beach towel is laid flat when in use.

In another embodiment of the present invention, the upper surface of the beach towel may include a configuration of, or be stylized to simulate the face of, a sun dial. By properly positioning the beach towel with respect to a north/south orientation, a person may selectively utilize their body or the shoulder carrying strap to function as the gnomon or style of the sun dial to cast a shadow which would give an indication of the general time of day.

2. History of the Related Art

Heretofore, many structures and designs have been developed for multi-functional beach or recreational type equipment. Included in such equipment are combination garments or combination articles including beach mats, beach towels, beach robes and similar items which may be folded or otherwise converted into an alternative configuration to form a satchel, pouch, tote bag, beach bag or other such item so that the original garment, mat, towel or the like can simultaneously serve several functions and thereby reduce the number of items which an individual carries to and from a recreational area including a beach, a pool, lakeside or the like.

Many people have experienced the inconvenience of having to transport personal items, belongings and lounge furniture to and from a beach or other resort or recreational location. Further, in many instances, it is not convenient for an individual to make two or more trips to and from a place of lodging or an automobile to carry equipment to and from a beach, lakeshore or other area. Therefore, it becomes necessary to manipulate a plurality of items at a single time including chairs, towels, lotions, sunglasses, wallets, keys, coolers, reading matter, umbrellas and the like at one time. The complexity and logistics of moving articles to and from a beach or other such area is further complicated when small children are present as parents are required to carry additional clothing, play equipment and other items in addition to the equipment that would normally be used.

To facilitate the transportation of articles to and from beaches or other recreational areas, individuals have made use of large tote bags in which a plurality of personal items may be selctively stored. Conventionally, such tote bags are canvas bags having carrying handles which may be either supported in a person's hand or suspended from a person's shoulder. Unfortunately, such beach bags offer only a single utility as carriers or storage satchels. Also, such conventional beach bags or tote bags are not normally provided with secure article retention pockets which may be utilized to house watches, jewelry, sunglasses and other items and keep such items separate and apart from other articles which are carried in the bags. Therefore, articles carried in conventional tote bags are mixed together and a person must search through the entire bag in order to locate particular items. In addition, conventional open tote bags or beach bags do not provide sufficient security for such items as wallets, change, watches and the like which should be kept or retained in an enclosed or sealed area.

A number of patents have been issued in the past to individuals who have designed new and unique combination garments, towels, mats or the like and tote bags. In U.S. Pat. No. 3,976,113 to Kim, a convertible blanket and tote bag is shown wherein the tote bag is formed by folding the towel along predesignated lines and thereafter securing edges of the blanket together with zippered components so that the blanket assumes a configuration of a satchel or open sack A pair of carrying straps are subsequently selectively attached to snap rings which are sewn or otherwise secured to the material forming the blanket. In this type of structure, reinforcing elements or tapes are sewn or secured in spaced locations to the material which forms the beach blanket. Such tapes serve as reinforcing for the edges of the tote bag and increase the rigidity of the bag. Unfortunately, such a structure requires that an individual converting the beach blanket to a bag follow a series of folding steps in order to form the tote bag from the extended beach blanket. Such folding not only requires a great deal of time and effort but also requires that the individual know how to make the folds in order to properly assemble the tote bag. Also, with this type of structure, any articles that are placed on the blanket, must be removed therefrom in order to allow the blanket to be folded to assume the tote bag configuration. The conversion of such structure therefore requires that many articles be placed on the ground or sand in surrounding relationship with respect to the blanket as it is folded. Thereafter, the articles must be again placed within the tote bag. In view of all the manipulation and movement of both articles and of the required assembling and folding that is encountered in converting such blankets into article carriers, such configurations are not satisfactory for normal use.

In U.S. Pat. No. 4,197,891 to Comollo another structure for a combination beach mat and shoulder bag is disclosed wherein the beach mat is in the form of a rectangular sheet of flexible material which is folded and secured by a plurality of connecting tapes which are secured in spaced location at various points along the surface of the mat or blanket This configuration not only is undesirable due to the requirement that the mat be folded into a properly assembled configuration, but also as the assembly must be secured by tape material which is placed on the surface of the blanket or mat. Such tape material may become coated or otherwise contaminated if the blanket were to be utilized in a sandy environment thereby adversely effecting the assembly of the tote bag from the folded beach blanket or mat. Further, as with the prior structure to Kim, the present structure would require that articles placed on the beach mat be removed therefrom in order to permit the tote bag to be assembled. Thereafter, articles would have to be replaced within the tote bag, all of which requires extra time and manipulative effort on the part of the person utilizing the combination article carrier and mat. Other prior art configurations for convertible beach towels or blankets which are folded along predesignated lines to form the tote bags are disclosed in U.S. Pat. Nos. 2,659,404 to Kelsey, 4,375,111 to Hall, 4,516,668 to Grayek and 2,344,010 to Walsh.

To provide additional security for personal belongings, some prior art combination beach towels and tote bags have been provided with separate pockets in which articles may be selectively retained. In U.S. Pat. No. 4,195,378 to Parker, a multi-purpose beach towel is disclosed which includes a plurality of individual pockets located at one end of the towel in which various personal items may be stored. This type of combination beach article offers more secure storage space, however, does not provide for additional carrying capacity when converted to a carrying package. In the particular structure of Parker, the towel is designed to be rolled from one end to the other when not in use with articles being retained within the pockets mounted thereto. A separate strap is provided which is placed around the rolled towel and may be utilized to transport the towel and the articles carried therein.

In U.S. Pat. No. 3,477,552, another combination mat and tote bag is disclosed which includes a separate pocket in which articles may be selectively stored. Unfortunately, the structure of this reference is similar to many of the aforementioned prior art structures and requires that the mat be folded in a specific manner in order to form a tote bag. As with the prior art references discussed above, it is complicated and time consuming to fold a blanket into a specific configuration and frequently, articles supported or placed on the beach towel or mat will have to be removed and then reinserted into the tote bag after it is formed. Other examples of combination covers or towels and portable bags are disclosed in U.S. Pat. Nos. 2,791,775 to Sartell and 3,176,315 to Freund.

In an effort to facilitate the conversion of a beach towel to a beach bag or tote bag, other prior art references have been designed to forego the requirement for folding the beach blanket or towel into a specific configuration. In U.S. Pat. No. 2,626,648 to Anderson, a combination towel and beach bag is disclosed having a pair of pull cords secured at each end of the towel. The ends of the pull cords may be tied in a diagonal relationship so as to create a pouch-like configuration for the towel so that the towel may be utilized to selectively carry other articles. Unfortunately, with this type of configuration, it is necessary that the ends of the pull cords be tied relative to one another and thereafter the entire assembly carefully lifted to insure that articles do not become dislodged from the towel as the towel is lifted by the pull cords. Further, even when assembled into a beach bag configuration, it is possible that articles can be accidentally displaced through the sides of the bag as the sides of the towel are not sealed with respect to one another.

In U.S. Design Pat. No. 128,122 to Lewis, a beach kit is disclosed having a generally flat body portion in which a variety of articles may be selectively stored. The kit is collapsible to form a tote bag by use of a pull string which is interwoven between folded sections of the panel portion of the beach kit. Unfortunately, with the structure disclosed, the kit is not designed to function as a beach blanket or towel as retention members are placed throughout the panel member. Also, the pull cord material would interfere with the use of the panel portion of the kit as a towel or blanket.

Other examples of prior art combination bags and clothing articles are disclosed in U.S. Pat. Nos. 2,315,126 to Michalke et al. and 2,731,997 to Muth et al.

SUMMARY OF THE INVENTION

This invention is directed to a combination beach blanket or towel and beach bag or tote bag wherein the towel includes upper and lower surface portions and opposite side and end portions. A pair of concentric and generally annular seams are formed joining the upper and lower surface portions of the beach towel and define an open annular channel therebetween in which a pull cord is movably retained. The pull cord is provided with a pair of oppositely disposed loops which extend outwardly of the channel and sides of the beach towel so as to be selectively engageable to thereby urge the pull cord outwardly of the towel to close the pull cord with respect to the towel. The portion of the towel which is located centrally of the concentric seams will be transformed into a carrying pouch as the pull cord is urged outwardly and the concentric seams will define an opening into the pouch which is closeable by urging the pull cord outwardly to its full extent to close the seams upon themselves. The ends of the pull cord may then be tied and the pull cord used as a carrying strap for the tote bag.

The invention further provides for pockets which are arranged in the corners of the beach towel and which pockets are selectively closable utilizing conventional fasteners such as VELCRO or zipper-type closures. In one embodiment of the invention, as the towel is converted into a beach tote bag, the corner portions of the towel will be disposed outwardly of the pouch with the openings into the pockets being vertically spaced above the bottom of the pockets so as to insure that articles placed therein are securely retained as the beach towel is converted to a carrying or tote bag. In another embodiment of the invention, the corners of the towel may be folded inwardly toward the center of the towel prior to urging the pull cord outwardly to convert the towel to a beach bag so that the pockets are simultaneously retained within the pouch defined by the central portion of the towel. In this manner, a different configuration for the tote bag is obtained which configuration will provide additional security for articles placed in the separate pockets.

As opposed to using the pull cord as a carrying strap for the combination beach towel and tote bag, a separate shoulder strap may be provided which is easily and quickly latched to each of the outwardly extending loops of the pull cord and which may be utilized to suspend the tote bag from an individual's shoulder.

In yet a further embodiment of the present invention, the upper surface of the beach towel may include indicia which is simulative of a sun dial. In this embodiment, the concentric seams will serve as the outer portion of the sun dial face with the style of the sun dial being provided either by a person standing in an appropriate position on the towel or by utilizing the separate shoulder strap which may be angled from the outer circumference of the dial face towards the center thereof and which can be utilized to cast a shadow with respect to the sun dial face to give an approximation of the time of day.

It is the primary object of the present invention to provide a combination beach blanket or towel and tote bag or beach bag in which the towel is converted to a tote bag by simply lifting the ends of a pull cord which are sewn intermediate the upper and lower portions of the beach towel with the central portion of the towel automatically being conformed to a pouch which is closable at its open and upper end by the pull cord.

It is yet another object of the present invention to provide a combination beach towel and tote bag which can be converted from a towel to a tote bag without requiring the towel to be folded into any predesignated or specific configuration and without requiring that articles be removed from the surface of the towel during the conversion process. With the present invention, articles which are placed on the surface of the towel may be moved to the central portion thereof and be simultaneously retained within the pouch formed as the beach towel is lifted by use of the pull strings or pull cords which are associated therewith.

It is another object of the present invention to provide a combination beach towel and tote bag which is provided with a plurality of article retaining pockets which are designed to be automatically suspended in a vertical relationship with the openings to the pockets being above the lower portion of the pockets when the beach towel is converted to a tote bag so that articles will not be displaced from the pockets during the conversion process.

It is yet another object of the present invention to provide a convertible beach towel and tote bag wherein the beach towel may have an upper surface which is in the configuration of the face of a sun dial so that the towel may be utilized to give an indication as to an approximate time of day and thereby enable a person to approximately judge the length of stay at a beach or other area without carrying a watch.

It is also an object of the present invention to provide a combination beach towel or blanket and tote bag or beach bag in which the tote bag or beach bag may have different configurations depending upon individual preference.

DESCRIPTION OF THE PREFERRED EMBODIMENT

Figure 2:
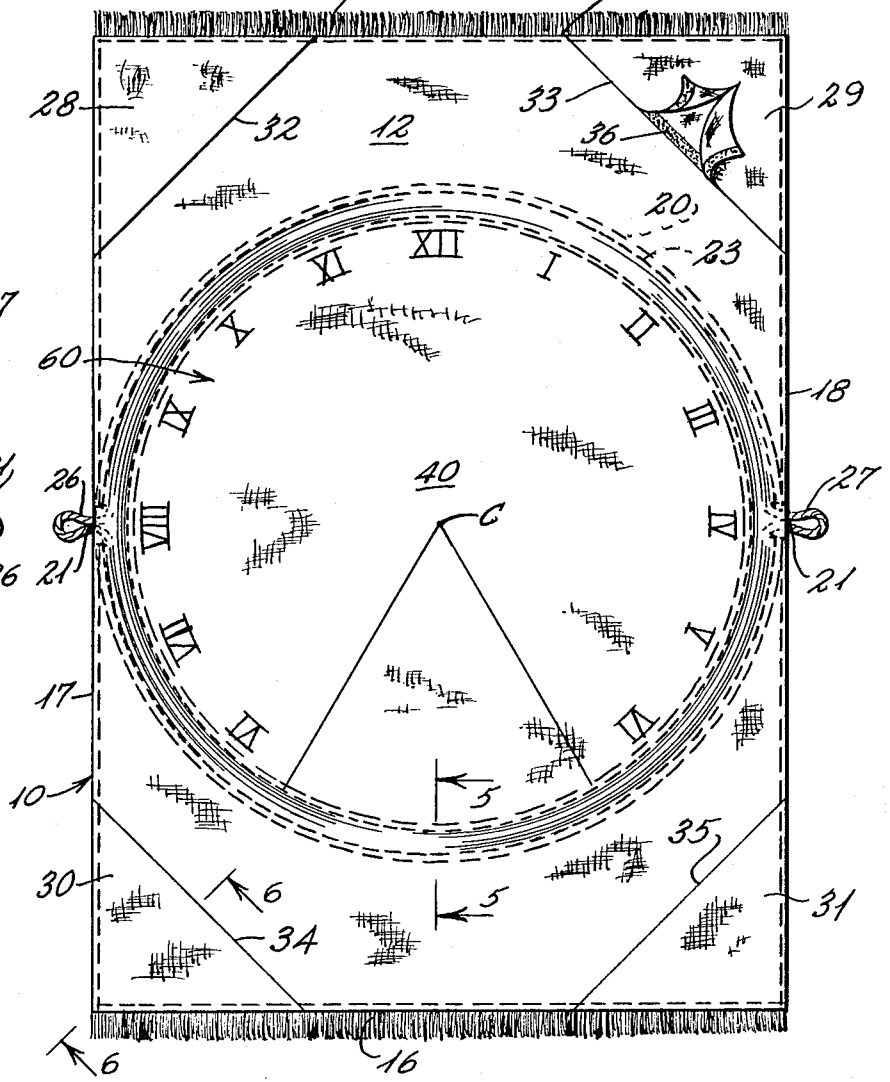
FIG. 2 is a top plan view of the embodiment of invention shown in FIG. 1 showing the upper surface of the beach blanket or towel having a surface design or configuration simulative of a sun dial face and showing the pull cords extending from the outer or opposite sides of the towel or blanket and further showing the pockets which are selectively closable using a VELCRO material.
Figure 1:
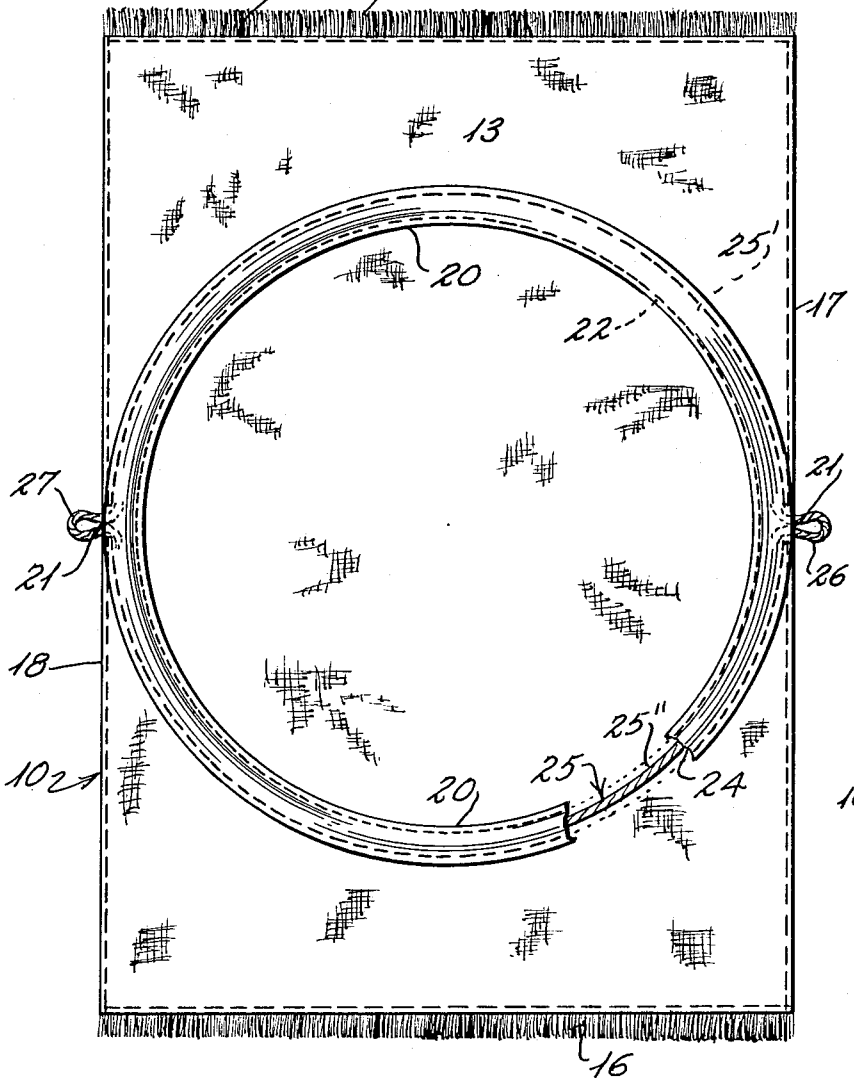
FIG. 1 is a bottom plan view of a preferred embodiment of the combination beach blanket or towel and tote bag of the present invention shown in an extended configuration having portions of an annular backing fabric or tape broken away showing the pull cord disposed intermediate the tape and opposing portion of the towel or blanket.
Figure 3:
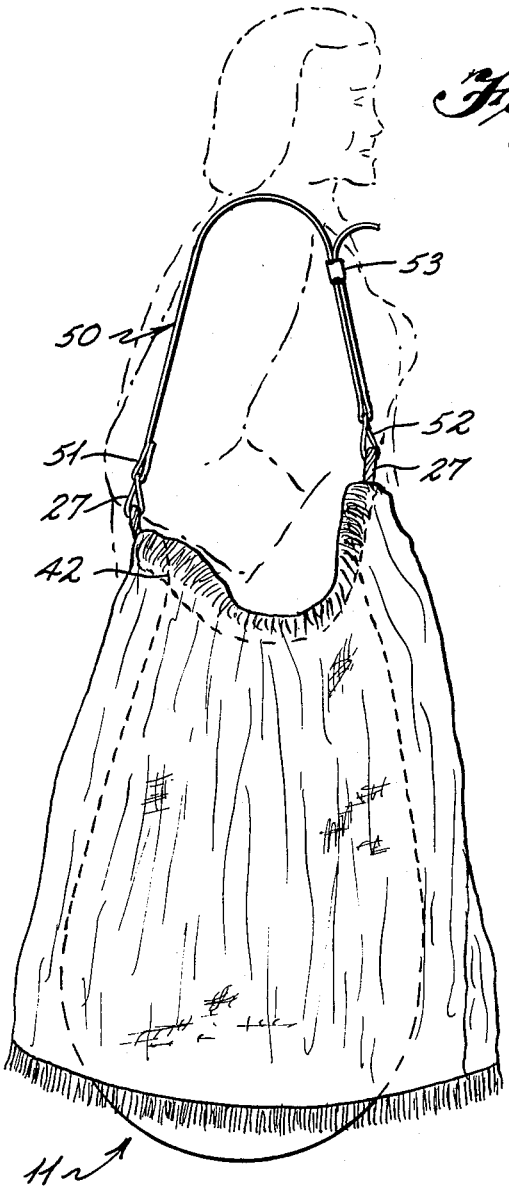
FIG. 3 is an illustrational view of the combination beach towel and tote bag shown in FIGS. 1 and 2 as it is shown converted to a tote bag having the corner portions of the blanket extending outwardly of the pouch formed from the central portion of the beach towel or blanket.
Figure 4:
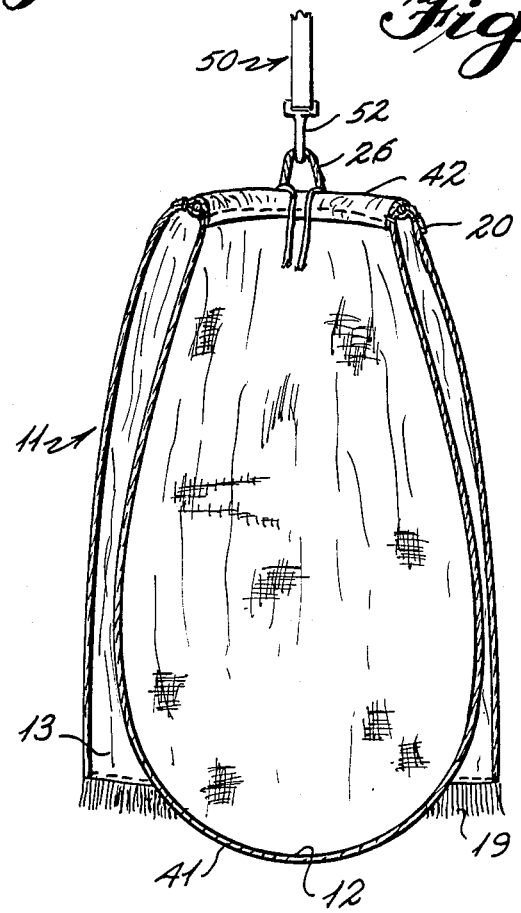
FIG. 4 is a cross sectional view of the tote bag or beach bag shown in FIG. 3.

With continued reference to the drawings, the combination beach blanket or towel and beach bag or tote bag of the present invention is shown in FIGS. 1 and 2 in the form of a blanket or towel 10 and in FIGS. 3 and 4 in the form of a tote bag or beach bag 11. In the preferred embodiment, the beach towel is formed of a cotton or other soft fabric material or of a terry cloth or towel-like fabric and includes upper and lower surfaces 12 and 13. The towel is defined by opposite ends 15 and 16 and sides 17 and 18. In the embodiment shown, the ends 15 and 16 of the towel may be provided with a conventional fringe as shown at 19.

A separate annularly shaped fabric or tape 20 is secured to the lower surface of the towel or blanket. The tape 20 is sewn or joined to the towel by concentric and generally annularly formed seams 22 and 23 which are spaced apart from one another a sufficient distance so as to create an open channel 24 between the tape and the lower surface of the towel. A pull cord 25 having spaced segments 25' and 25'' is disposed within the open channel 24 and has a pair of looped end portions 26 and 27 which extend outwardly through a pair of oppositely oriented seam openings 21 provided in the outer annular seam 23 which secures the tape to the blanket or towel. Each of the looped end portions 26 and 27 may include a knotted portion adjacent the seam 23 which knotted portion will prevent the looped ends from being pulled inwardly with respect to the channel 24 so that the end portions are thereby insured of being available and disposed outwardly with respect to the edge portions of the towel or blanket when the towel or blanket is in use.

As the spaced segments of the pull cord 25 are encased between the upper and lower fabric layers of the beach towel or blanket and fabric tape, the cord segments will not interfere with the use of the blanket or towel in a conventional manner as a resting surface or a drying surface. In addition, the pull cord may be made of a very strong nylon material which is extremely durable and may have a cross sectional diameter which may be as little as 1/16 of an inch. Because of the small diameter of the pull cord, and because the pull cord is fully closed, the pull cord will barely be detectable to a person utilizing the blanket or beach towel. Also, it should be noted that the configuration of the channel could be changed so long as the cord segments are spaced from one another.

Figure 6:
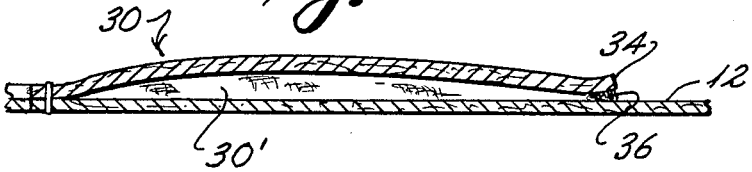
FIG. 6 is a cross sectional view taken along lines 6—6 of FIG. 2 taken through one of the pockets formed in the upper surface of the blanket or towel of the present invention.

The upper surface 12 of the beach towel or blanket 10 is further provided with corner pockets identified at 28, 29, 30 and 31. Each of the pockets defines a cavity such as shown in FIG. 6 as 30' in which various personal articles such as keys, sunglasses, wallets, watches or other items may be selectively stored and secured. Further, each pocket is provided with a closure mounted along the innermost edge portions 32, 33, 34 and 35 of the pockets 28, 29, 30 and 31, respectively. Each of the innermost edges is closed by a conventional fastener material which may be VELCRO as shown at 36 in FIG. 6 and FIG. 2. If desired, other conventional fasteners such as zippers could be provided along the innermost edge portions of the pockets to selectively close the pockets to secure articles therein. The outermost edges of each of the pockets 28, 29, 30 and 31 are joined to the upper and lower surfaces of the towel or blanket by the outer seams which extends around the edge of the blanket or as an alternative, a separate seam may be provided to secure each of the pockets to the upper surface of the towel or blanket.

When it is desired to convert the beach towel or blanket 10 to the tote bag or beach bag 11, the present invention is designed to permit the conversion to be made by simply lifting on the outer looped end portions 26 and 27 of the pull cord 25 and thereafter pulling the outer end portions outwardly with respect to the sides 17 and 18 of the beach blanket or towel. As the pull cord is being manipulated, the central portion 40 of the beach towel which is encircled by the concentric seams 22 and 23 will form a pouch or bag 41. The upper edges of the pouch or bag 41 will thereby be defined by the concentric seams and annular tape, as shown at 42 in the drawings. The upper open edge 42 is therefore closable by further urging the pull cord 25 outwardly with respect to the sides of the fabric forming the upper and lower surfaces of the towel or blanket and the pull cord may be urged outwardly to an extent where the opening 42 is fully collapsed thereby completely closing any opening into the bag 41. During the conversion process, the corner pockets 32, 33, 34 and 35 of the beach towel will be allowed to simply fall vertically adjacent the exterior surface of the bag. Due to the placement of the corner pockets and the openings 32, 33, 34 and 35 therein, the openings will be positioned in a vertically elevated position with respect to the lower or bottom portions of the pockets thereby insuring that the contents or articles placed within the pockets are retained within the pockets as the towel or beach blanket is lifted and formed into the pouch configuration shown in FIGS. 3 and 4.

One of the benefits of the present invention is that the conversion of the invention from a beach towel or blanket to a tote bag or beach bag may be accomplished in such a manner that any articles that are placed on the beach towel or beach blanket need not be removed during the conversion process. Specifically, any articles such as books, sun tan lotion, toys and other items may be placed within the central portion 40 of the beach towel prior to urging the pull cord upwardly and outwardly to form the pouch configuration shown in FIGS. 3 and 4. As the pouch is formed, articles will be simultaneously enclosed within the pouch and thereby protected from being accidentally misplaced during the conversion process.

Although the looped ends 26 and 27 of the pull cord 25 may be tied together to create a carrying strap for the tote bag, a separate shoulder strap 50 such as shown in FIGS. 3 and 4 may be selectively attachable to the looped end portions 26 and 27. The shoulder strap 50 includes snap hooks 51 and 52 mounted at each end thereof and an adjustment buckle 53 which may be utilized to selectively alter the length of the shoulder strap to conform to the individual utilizing the combination beach blanket and tote bag. When not in use, the shoulder strap 50 may be selectively stored in one of the pockets 28–31 or may be left secured with one of the latch hook ends 50 and 52 secured to one of the looped ends 26 and 27 of the blanket or towel.

The preferred embodiment of the invention as shown in FIG. 2 of the drawings reflects that the upper surface of the beach blanket is formed so as to simulate the face of a sun dial in the central area 40 thereof. With this configuration, the area between the concentric seams and channel 22 and 23 define the outer portion of a sun dial face 60 having indicia representing the hours of the day placed in spaced relationship adjacent the innermost concentric seam 22. As with a conventional sun dial, a lower segment 61 of the face of the sun dial is left free of indicia and provides an area for placement of a makeshift gnomon or style which is utilized to cast a shadow. The makeshift gnomon may be a person's body or the shoulder strap may be utilized and extended from the concentric seams toward the center C of the sun dial face at an angle prescribed for a given season and latitude so that an approximate time shadow may be cast relative thereto.

Figure 7:
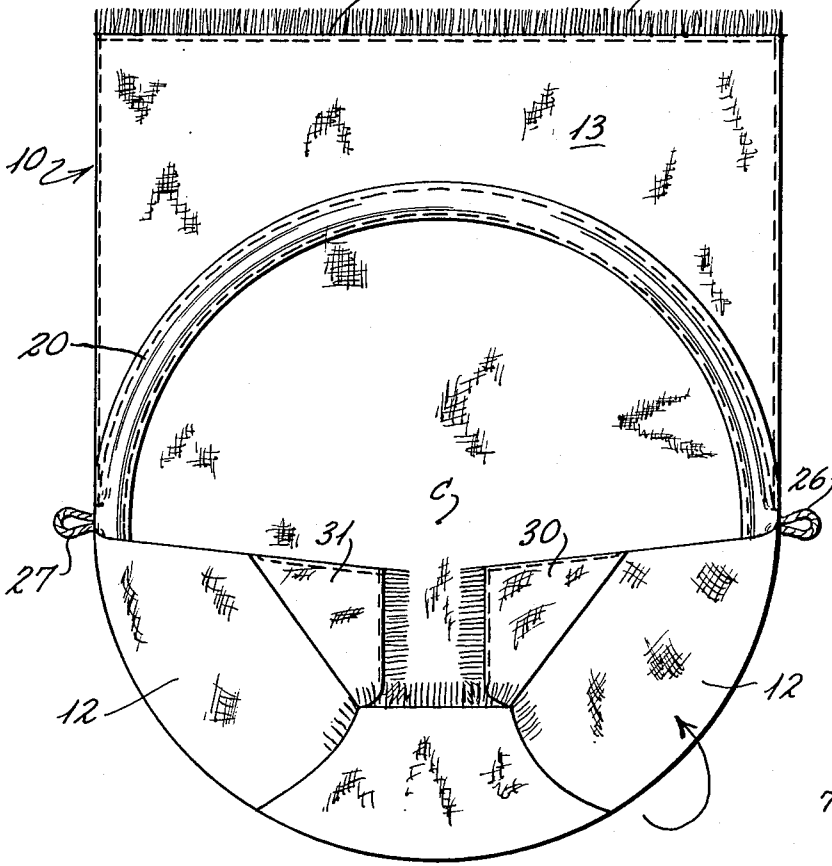
FIG. 7 is a top plan view showing a second manner of folding the beach blanket or towel of the present invention so that the pockets are placed inwardly of the pouch formed as the pull cords are urged outwardly of the towel so that the corner pockets are retained within the tote bag or beach bag.

The present invention is also designed to be modified so that the tote bag or beach bag may have several different appearances. One type or style is shown and has been described with respect to FIGS. 3 and 4 of the drawings. In this embodiment, the corners of the beach blanket or towel are suspended from the exterior of the pouch 41 so that the pockets are suspended exteriorly thereof. With reference to FIG. 7 of the drawings, the corners of the beach blanket may be folded towards the center C thereof prior to the pull cord being lifted and pulled so that the pockets 28, 29, 30 and 31 will be disposed inwardly of the pouch 41 as it is formed In this respect, the pockets of the towel will be confined within the pouch.

Figure 9:
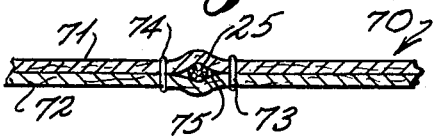
FIG. 9 is an enlarged cross sectional view taken along lines 9—9 of FIG. 8.
Figure 5:
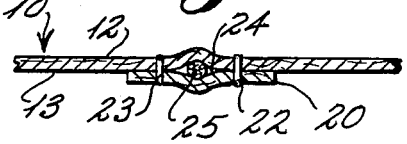
FIG. 5 is an enlarged cross sectional view taken along lines 5—5 of FIG. 2 showing the pull cord disposed between the concentric seams which define the open channel between the annular fabric, or tape backing and the lower surface of the beach blanket or towel.
Figure 8:
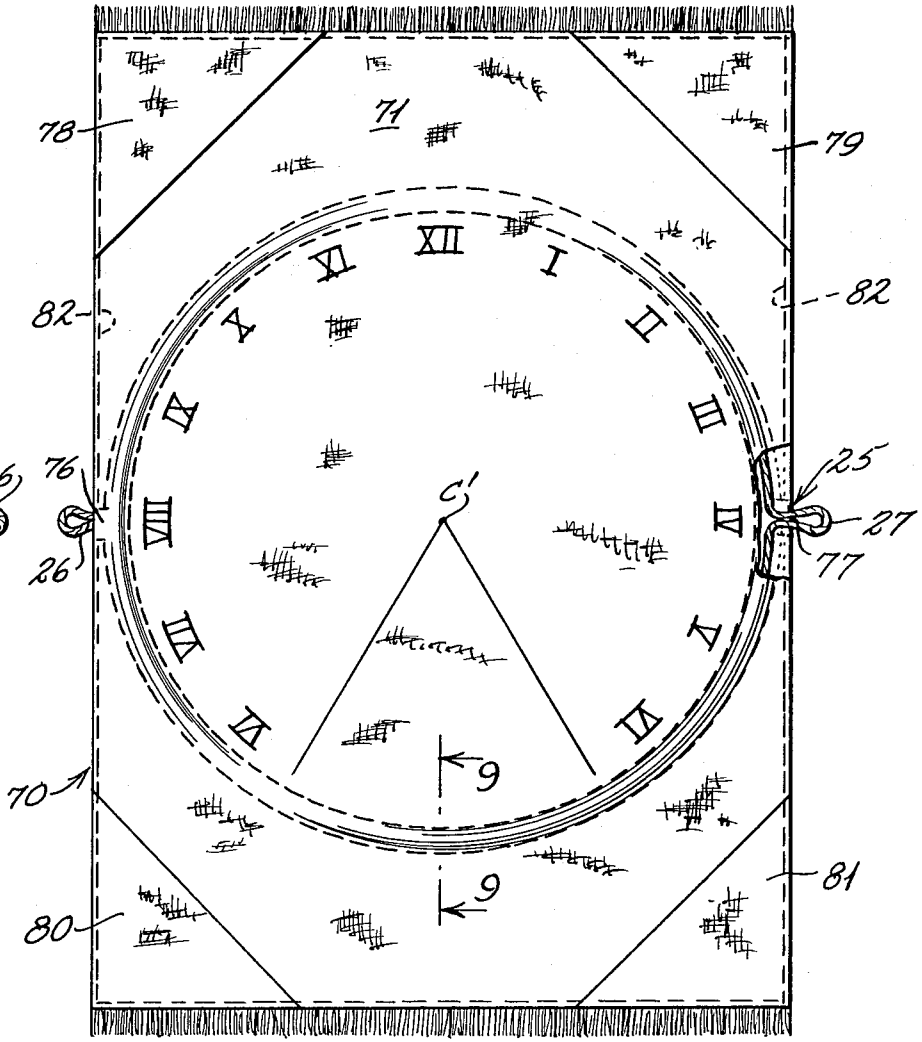
FIG. 8 is a top plan view of another embodiment of the present invention wherein the towel or blanket is formed of upper and lower fabric material layers having an annular seam formed therebetween which defines an enclosed channel for the pull cord.

Although the preferred embodiment has been disclosed as having a channel 24 created between an annular fabric or tape 20 and the lower surface of the towel or blanket, it should be noted that the channel may be formed in other ways. For instance, and although not shown in the drawings, the annular tape 20 could be replaced by a separate enlarged circular fabric layer which could be joined to one of the upper or lower surfaces 12 and 13 of the towel by concentric stitching. A further embodiment is shown in FIGS. 8 and 9 which includes upper and lower generally coextensive fabric layers. In this embodiment, the beach blanket is designated at 70 and will include an upper fabric layer 71 and lower fabric layer 72. The upper and lower fabric layers are joined along their outermost edges by stitching 82. The central portion C' of the composite blanket or towel is encircled by concentric seams 73 and 74 which define a generally annular channel 75 therebetween. In this embodiment, the pull cord 25 is positioned within the channel 75 between the upper and lower fabric layers with the outer portions 26 and 27 thereof extending outwardly through pairs of openings 76 and 77 provided in the seam 74 and stitching 82. Separate pocket members 78, 79, 80 and 81 may be secured to the corners of the upper fabric material and are closable in the same fashion as discussed with respect to the embodiment of the invention shown in FIGS. 1–7.

The convertability of the embodiment of FIGS. 8 and 9 is the same as that of the blanket and tote bag as disclosed with respect to FIGS. 1–7. Further, the same sun dial concept may be utilized on the upper surface 72 of the composite towel or blanket.

We claim:

1. A combination beach towel and beach bag comprising a towel having upper and lower portions and edge portions, a pull cord means disposed between said upper and lower portions of said towel and having first and second spaced segments which are spaced with respect to one another between said upper and lower portions, means for securing said pull cord means between said upper and lower portions of said towel, at least one opening between said upper and lower portions of said towel, said pull cord means having an outer portion which extends through said opening in said upper and lower portions of said towel, said towel including a general central portion which is disposed between said first and second segments of said pull cord means so as to be substantially surrounded thereby, said outer portion of said pull cord means which extends exteriorly of said opening being movable outwardly with respect to said upper and lower portions of said towel so as to thereby form said central portion of said towel into a beach bag having a pouch means with an opening which is selectively closable by said first and second segments of said pull cord means, said towel having opposite side and end portions which define four corner portions, at least one pocket secured to one of said four corner portions of said towel, said pocket having a storage portion and an opening extending generally diagonally between one of said end and said side wall portions of said towel, and said opening in said pocket being vertically elevated with respect to said storage portions when said towel is converted to a beach bag.

2. The combination beach towel and blanket of claim 1 including a pocket means secured at each of said four corner portions of said towel and closure means for selectively closing said openings in each of said pockets.

3. The combination beach towel and beach bag of claim 1 in which one of said upper and lower portions of said towel is formed as a generally annular ring-like member having inner and outer edges, said first and second segments of said pull cord means being disposed between said ring-like member and the other of said upper and lower portions of said towel.

4. The combination beach towel and beach bag of claim 1 in which said upper and lower portions of said towel are formed as separate fabric panel members which are substantially coextensive with respect to one another, means for joining said fabric panel members to one another, said means for securing said pull cord means between said upper and lower surface portions of said towel including generally concentric and substantially continuous lines of uniting means which are made through said fabric panel members to thereby define an open and substantially continuous channel between said fabric panel members in which said first and second segments of said pull cord means are adjustably disposed.

5. The combination beach towel and beach bag of claim 4 including a pair of spaced openings made through the outer line of concentric uniting means so as to form first and second spaced openings between said fabric panel members, said pull cord means having first and second outer portions extending through said first and second spaced openings.

6. The combination beach towel and beach bag of claim 4 including shoulder strap means, said shoulder strap means having end portions, engagement means carried by each of said end portions of said strap means, said engagement means being selectively engageable with said outer portions of said pull cord means whereby said strap means may be selectively utilized to carry said beach bag.

7. The combination beach towel and beach bag of claim 1 including sun dial indicia means applied to said upper portion of said towel, said sun dial indicia means including spaced hour indicia and a style segment area, whereby an object may be placed within said style segment area and generally centrally of said hour indicia to reflect a general time of day.

8. The combination beach towel and beach bag of claim 1 including shoulder strap means, and means for selectively connecting said shoulder strap means to said outer portion of said pull cord means.

9. A combination beach towel and beach bag comprising a towel having upper and lower fabric layers, each of said upper and lower fabric layers having outer edge portions, a plurality of pockets secured to said upper fabric layer of said towel, each of said pockets having an opening spaced toward said central portion of said upper fabric layer, means for securing said first and second layers so as to form a generally circular and open passageway between said upper and lower layers, first and second spaced openings formed in said passageway, a pull cord means disposed within said passageway, said pull cord means having first and second outer portions which extend outwardly of said edge portions of at least one of said upper and lower fabric layers through said first and second openings, respectively at least one of said upper and lower fabric layers having generally centralized portions which are surrounded by said passageway, said first and second outer portions of said pull cord means being selectively movable outwardly with respect to said towel so as to form said central portion of said upper and lower fabric layers into a pouch means for the beach bag, the beach bag having an opening which is selectively closable by said pull cord means, said upper fabric layer having opposite side and end portions which define spaced corners, one of said pocket means being disposed adjacent each of said corners of said towel, each of said pockets having an opening spaced toward said central portion of said upper fabric layer, each of said corners of said towel being foldable inwardly so that said pocket means may be positioned in overlying relationship with respect to said central portion of said upper fabric layer whereby when said first and second outer ends of said pull cord means are pulled outwardly of said towel, said pocket means will be retained within said pouch means of the beach bag.

10. The combination beach towel and beach bag of claim 9 including shoulder strap means, said shoulder strap means having end portions, engagement means carried by each of said end portions of said strap means, said engagement means being selectively engageable with said first and second outer portions of said pull cord means whereby said strap means may be selectively utilized to carry said beach bag.

11. The combination beach towel and beach bag of claim 9 including means for selectively securing said edge portion of said pockets so as to selectively retain articles therein.

12. A beach towel comprising upper and lower surfaces, sun dial indicia means provided along said upper surface of said beach towel, said indicia means including numerals indicating hours of the day, a style section incorporated with said sun dial configuration, said style section converging inwardly towards the center of said sun dial configuration whereby when an object is placed within said style section so as to extend toward said center of said sun dial configuration, a shadow may be cast which is indicative as to the general time of day.

13. A combination beach towel and beach bag comprising a towel having upper and lower portions and edge portions, a pull cord means disposed between said upper and lower portions of said towel and having first and second spaced segments which are spaced with respect to one another between said upper and lower portions, means for securing said pull cord means between said upper and lower portions of said towel, at least one opening between said upper and lower portions of said towel, said pull cord means having an outer portion which extends through said opening in said upper and lower portions of said towel, said towel including a general central portion which is disposed between said first and second segments of said pull cord means so as to be substantially surrounded thereby, said outer portion of said pull cord means which extends exteriorly of said opening being movable outwardly with respect to said upper and lower portions of said towel so as to thereby form said central portion of said towel into a beach bag having a pouch means with an opening which is selectively closable by said first and second segments of said pull cord means, and sun dial indicia means applied to said upper portion of said towel, said sun dial indicia means including spaced hour indicia and a style segment area, whereby an object may be placed within said style segment area and generally centrally of said hour indicia to reflect a general time of day.

14. The combination beach towel and beach bag of claim 13 including at least one pocket secured to said towel and spaced outwardly with respect to said central portion thereof.

15. A combination beach towel and beach bag comprising a towel having upper and lower portions and edge portions, a pull cord means disposed between said upper and lower portions of said towel and having first and second spaced segments which are spaced with respect to one another between said upper and lower portions, means for securing said pull cord means between said upper and lower portions of said towel, at least one opening between said upper and lower portions of said towel, said pull cord means having an outer portion which extends through said opening in said upper and lower portions of said towel, said towel including a general central portion which is disposed between said first and second segments of said pull cord means so as to be substantially surrounded thereby, said outer portion of said pull cord means which extends exteriorly of said opening being movable outwardly with respect to said upper and lower portions of said towel so as to thereby form said central portion of said towel into a beach bag having a pouch means with an opening which is selectively closable by said first and second segments of said pull cord means, said towel having opposite side and end portions which define four corner portions, at least one pocket secured to one of said four corner portions of said towel, said pocket having a storage portion and an opening, each of said corner portions being selectively foldable inwardly into overlying relationship with respect to said central portion of said upper fabric layer so that said pocket may be selectively placed inside or outside of said pouch means when said towel is converted to the beach bag.

* * * * *